US006039108A

United States Patent [19]

Hanano et al.

[11] Patent Number: 6,039,108

[45] Date of Patent: Mar. 21, 2000

[54] SLEEVE LUBRICATING METHOD AND SLEEVE LUBRICATING MECHANISM

[75] Inventors: Takashi Hanano; Hisataka Shibuya, both of Kobe, Japan

[73] Assignee: Hanano Corporation, Hyogo-ken, Japan

[21] Appl. No.: 08/954,892

[22] Filed: Oct. 21, 1997

[30] Foreign Application Priority Data

Sep. 22, 1997 [JP] Japan ..... 9-256579

[51] Int. Cl.[7] ..... B22D 17/12

[52] U.S. Cl. ..... 164/72; 164/113; 164/149; 164/312

[58] Field of Search ..... 164/72, 113, 312, 164/267, 149

[56] References Cited

U.S. PATENT DOCUMENTS 5,385,196 1/1995 Hanano ..... 164/72

FOREIGN PATENT DOCUMENTS 63-224842 9/1988 Japan ..... 164/267
4-89168 3/1992 Japan ..... 164/312
577085 10/1977 Russian Federation ..... 164/72
1148694 4/1985 Russian Federation ..... 164/72

*Primary Examiner*—Kuang Y. Lin
*Attorney, Agent, or Firm*—Evenson, McKeown, Edwards & Lenahan, PLLC

[57] ABSTRACT

A sleeve lubricating mechanism which is able to positively coating a powder lubricant onto an inside surface of a molten metal feeding sleeve for a vertical shot casting machine. This mechanism is composed of an attachment which contacts with a molten metal feeding port of the sleeve to block it so as to bring a sleeve inside to a closed condition, a vacuum device sucking air from the sleeve inside through the attachment, and a powder feeding device discharging the powder lubricant together with air from a nozzle into the sleeve inside through the attachment.

6 Claims, 2 Drawing Sheets

SLEEVE LUBRICATING METHOD AND SLEEVE LUBRICATING MECHANISM

BACKGROUND OF THE INVENTION

This invention relates to a sleeve lubricating method and a sleeve lubricating mechanism, in which a powder lubricant is coated on an inside surface of a molten metal feeding sleeve for a vertical shot casting machine.

Water dispersion of graphite or inorganic substance (such as talc, mica etc.) has conventionally been used for a lubricant. This water dispersion has been sprayed onto the inside surface of the molten metal feeding sleeve for the vertical shot casting machine, while vertically moving an atomizer and an air blow nozzle attached to a drive device. In other words, the water dispersion has been sprayed from the atomizer, and moisture of the sprayed water dispersion has been removed by the air blow nozzle.

However, the above method spraying the lubricant forming the water dispersion has included the following problems.

(a) The lubricant has been scattered to stain places around the sleeve. Especially, the graphite water dispersion has caused a worse working environment.

(b) High air blow noise emitted when removing moisture and requiring an operator to have a soundproof device on, have caused a worse workability.

(c) Clogged atomizer and air blow nozzle unable to coat the lubricant uniformly, have probably induced to ununiformity of product quality.

In order to eliminate the troubles induced by using the water dispersion for the lubricant, use of a powder lubricant has been tried. However, it has been difficult to positively coat the powder lubricant onto the inside surface of the sleeve.

BRIEF SUMMARY OF THE INVENTION

A first object of this invention is to provide a sleeve lubricating method which is able to positively coat the powder lubricant onto the inside surface of the molten metal feeding sleeve for the vertical shot casting machine.

A second object of this invention is to provide a sleeve lubricating mechanism which is able to put the foregoing sleeve lubricating method into practice.

In order to accomplish the above first object, the sleeve lubricating method of this invention is a method for coating the powder lubricant onto the inside surface of the molten metal feeding sleeve for the vertical shot casting machine, comprising an attachment setting process in which a molten metal feeding port of the sleeve is blocked by the attachment to bring a sleeve inside to a closed condition, and a coating process in which the powder lubricant is discharged together with air by a powder feeding device from the nozzle into the sleeve inside through the attachment, while sucking air from the sleeve inside by a vacuum device through the attachment.

According to the sleeve lubricating method of this invention, since the powder lubricant is discharged from the nozzle in the coating process while reducing pressure from the sleeve inside, the powder lubricant is easily dispersed widely in the sleeve inside to reach every corners of sleeve inside and adhere thereto. Consequently, a preferable lubrication effect can be obtained in a molten metal feeding work.

Further, since the powder lubricant is discharged from the nozzle into the sleeve inside under the pressure reduced condition, the clogging of the powder lubricant at the nozzle can be avoided. Therefore, the powder lubricant can be coated positively, the desired lubrication effect can always be obtained, and a quality of cast product can be stabilized.

In addition, since the coating process is carried out under the closed condition, air noise is prevented from emitting outside and places around the sleeve can be prevented from being stained.

In the sleeve lubricating method of this invention, the following constructions may be used.

(1) In the coating process, a protruding length of the nozzle into the sleeve inside is set to a prescribed value. According to this construction, an adhering degree of the powder lubricant onto the inside surface of sleeve can be adjusted.

(2) In the coating process, a sucking force of the vacuum device and an air discharging pressure and capacity of the powder feeding device can be set to prescribed values. According to this construction, the process can be adapted to various work conditions.

In order to accomplish the above second object, the sleeve lubricating mechanism of this invention is a mechanism for coating the powder lubricant onto the inside surface of the molten metal feeding sleeve for the vertical shot casting machine, comprising the attachment which contacts with a molten metal feeding port of the sleeve to block it so as to bring the sleeve inside to a closed condition, the vacuum device sucking air from the sleeve inside through the attachment, and the powder feeding device discharging the powder lubricant together with air from the nozzle into the sleeve inside through the attachment.

According to the sleeve lubricating mechanism of this invention, the sleeve lubricating method of this invention can be put into practice by a simple construction.

In the sleeve lubricating mechanism of this invention, the following construction may be used further.

(3) The nozzle secured to the attachment is composed of a copper pipe whose length can be adjusted by being cut. According to this construction, the above construction (1) can be put into practice by a simple work.

(4) The sucking force of the vacuum device and the discharge pressure and capacity of the powder feeding device can be adjusted. According to this construction, the above construction (2) can be put into practice.

DETAILED DESCRIPTION OF THE INVENTION

Figure 1:
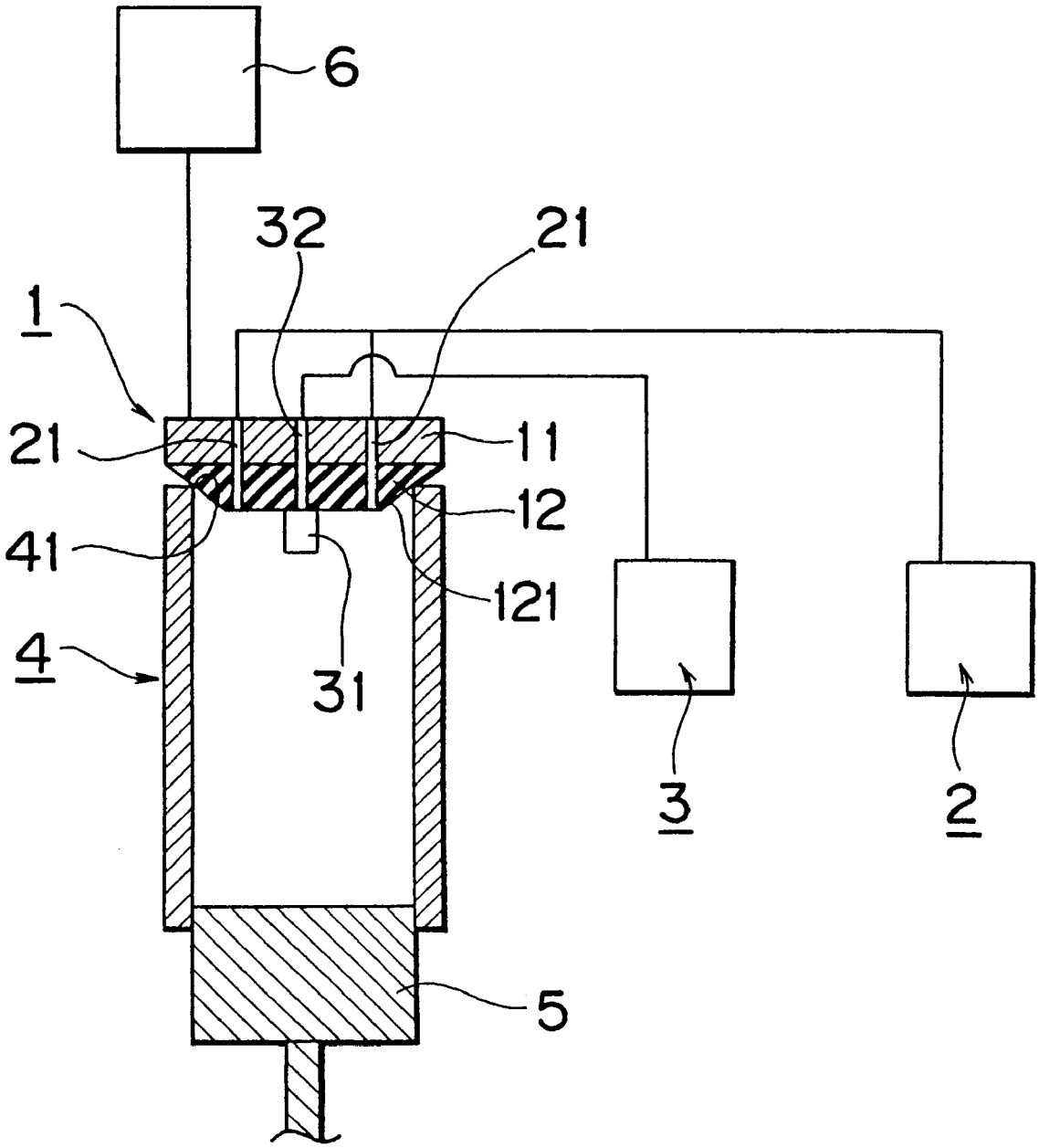
FIG. 1 is a vertical sectional view showing a state where the sleeve lubricating mechanism of this invention is applied to the molten metal feeding sleeve for the vertical shot casting machine.

FIG. 1 is the vertical sectional view showing the state where the sleeve lubricating mechanism of this invention is applied to the molten metal feeding sleeve for the vertical shot casting machine. The sleeve lubricating mechanism of this invention is composed of an attachment 1, a vacuum device 2 and a powder feeding device 3.

The attachment 1 is installed in such a way that it can move in both lateral and vertical directions by a drive device 6, and contacts with a molten metal feeding port 41 of a sleeve 4 to block it so as to bring an inside of the sleeve 4 to a closed condition. A plunger tip 5 fits in the sleeve 4 freely slidingly from under side. The attachment 1 is formed into a thick disk-shape having a double structure comprising a body section 11 and a contacting section 12. The body section 11 is made of aluminum and the contacting section 12 is made of silicon rubber, and a contacting part 121 of the contacting section 12 with the molten metal feeding port 41 is formed into a tapered shape.

The vacuum device 2 is a device which sucks air from an inside of the sleeve 4 through the attachment 1. A sucking force is made adjustable. A sucking passage 21 is formed in and piercing through the attachment 1.

The powder feeding device 3 is a device which discharges the powder lubricant together with air from a nozzle 31. An air discharge pressure and its capacity are made adjustable. The nozzle 31 is made of a copper pipe and so installed as to protrude downward from the contacting section 12 of the attachment 1. The nozzle 31 is adjustable in its length to a voluntary value by cutting the copper pipe. A discharge passage 32 connecting to the nozzle 31 is formed in and piercing through the attachment 1.

Figure 2:
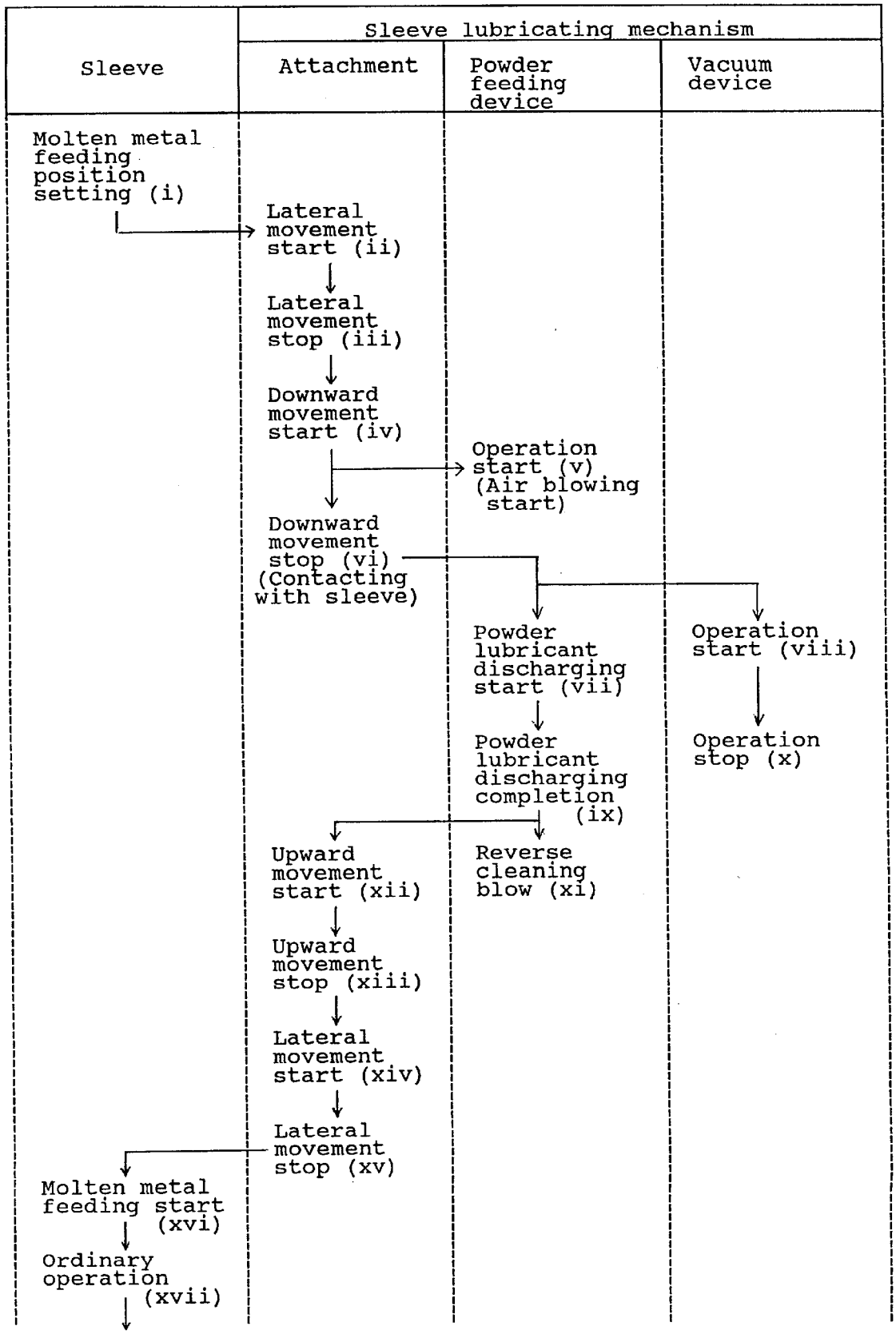
FIG. 2 is a flow chart showing a work process of the sleeve lubricating mechanism of this invention.

A function of the sleeve lubricating mechanism having the above structure, i.e. the sleeve lubricating method of this invention, will be described hereunder. FIG. 2 is the flow chart showing the work process of the sleeve lubricating mechanism.

When the sleeve 4 is set to a molten metal feeding position (process i), the attachment 1 is first moved in lateral direction by the drive device 6 (process ii). When it comes just above the sleeve 4, its movement is stopped (process iii).

Then, downward movement of the attachment 1 is commenced (process iv), and the powder feeding device 3 is operated to let air blow from the nozzle 31 (process v).

In the next stage, when the attachment 1 contacts with the molten metal feeding port 41 of the sleeve 4, the downward movement of the attachment 1 is stopped (process vi). Then, the discharging of the powder lubricant from the nozzle 31 is commenced (process vii), and at the same time the vacuum device 2 is operated (process viii).

In the next stage, when a specified quantity of the powder lubricant has been discharged, the discharging of the powder lubricant is completed (process ix) and at the same time or later the operation of the vacuum device 2 is stopped (process x).

In the next stage, the attachment 1 is moved upward and then in the lateral direction (processes xii to xv). Molten metal is poured from the molten metal feeding port 41 into the sleeve 4 (process xvi), so that an ordinary molten metal feeding work, i.e. a casting work, is carried out (process xvii). Reverse cleaning blow work is carried out by the powder feeding device 3 at a voluntary set time (process xi).

According to the foregoing sleeve lubricating method, in the coating process described in the processes vii to x, the powder lubricant is discharged from the nozzle 31 while reducing pressure from the inside of the sleeve 4 by the vacuum device 2. Therefore, the powder lubricant is scattered easily and widely in the sleeve 4 and comes to every corners and adheres thereto in the sleeve 4. Consequently, a preferable lubrication effect can be provided in the molten metal feeding work carried out by sliding the plunger tip 5.

Since the powder lubricant is discharged from the nozzle 31 into the inside of the sleeve 4 under the pressure reduced condition, the powder lubricant is prevented from clogging at the nozzle 31. Consequently, the powder lubricant is coated positively, the desired lubrication effect is always obtained and the quality of cast product is stabilized.

Since the coating process described in the processes vii to x, is carried out under the closed condition, air noise is scarcely emitted outside and places around the sleeve 4 are not stained.

Since the nozzle 31 is adjustable in its length, the degree of adhesion of the powder lubricant onto the inside surface of the sleeve 4 can be adjusted.

Further, since the sucking force of the vacuum device 2 and the air discharge pressure and capacity of the powder feeding device 3 can be set to voluntary values, the coating process can be adapted to various working conditions.

Table 1 shows results comparing the method of this invention and the conventional method. The sleeve lubricating method of this invention is as described above, and the conventional sleeve lubricating method is as described below. While the atomizer and air blow nozzle attached to the drive device are moved in vertical direction, the graphite water dispersion is sprayed from the atomizer onto the inside surface of the sleeve, so that the moisture of the water dispersion is removed by the air blow nozzle.

TABLE 1

| Results of comparison | Conventional method | Method of this invention |
|---|---|---|
| Stain preventing effect around sleeve | x | ○ |
| Air noise preventing effect | x | ○ |
| Quality stabilizing effect | x | ○ |
| Lubridation effect | ○ | ○ |

○ . . . Good, x . . . Bad

As obvious from Table 1, according to the method of this invention, the stain preventing effect, air noise preventing effect and the quality stabilizing effect are superior to those of the conventional method.

We claim:

1. A lubrication method for a molten metal feeding sleeve of a vertical shot casting machine, the method comprising the acts of:

moving an attachment into a position in contact with and closing-off a molten metal feeding port opening of the sleeve to form a closed interior of the sleeve;

suctioning air via an air passage extending through the attachment from the interior of the sleeve via the molten metal feeding port opening with a vacuum device; and discharging both powder lubricant and air from a nozzle extending into the interior of the sleeve through the molten metal feeding port opening via a passage extending through the attachment to coat the interior of the sleeve with the powder lubricant.

2. A sleeve lubricating method as set forth in claim 1, in which a protruding length of the nozzle into the sleeve inside is set to a prescribed value in the coating process.

3. A sleeve lubricating method as set forth in claim 1, in which a sucking force of the vacuum device and an air discharging pressure and capacity of the powder feeding device are set to prescribed values in the coating process.

4. A lubricating system in a vertical shot casting machine, comprising:

a molten metal feeding sleeve of the vertical shot casting machine, the feeding sleeve having a single molten metal feeding port opening;

an attachment sized to contact and close-off the single molten metal feeding port opening to provide a closed interior within the feeding sleeve;

a vacuum device having a passage extending through the attachment to suck air from the interior of the sleeve through the single molten metal feeding port opening; and a powder lubricant feeding device having a feed passage extending through the attachment, a nozzle being arranged at one end of the feed passage, the nozzle protruding into the interior of the sleeve through the single molten metal feeding port opening; and wherein both powder lubricant and air are discharged through the nozzle into the interior of the sleeve.

5. A sleeve lubricating mechanism as set forth in claim 4, in which the nozzle attached to the attachment is composed of a copper pipe having an adjustable length via cutting.

6. A sleeve lubricating mechanism as set forth in claim 4, further comprising means for adjusting a sucking force of the vacuum device and an air discharging pressure and capacity of the powder feeding device.

* * * * *